US006793738B2

(12) United States Patent
Kool et al.

(10) Patent No.: US 6,793,738 B2
(45) Date of Patent: Sep. 21, 2004

(54) METHOD FOR PROCESSING ACID TREATMENT SOLUTION, SOLUTION PROCESSED THEREBY, AND METHOD FOR TREATING ARTICLES THEREWITH

(75) Inventors: Lawrence Bernard Kool, Clifton Park, NY (US); James Anthony Ruud, Delmar, NY (US); Ralph James Carl, Jr., Clifton Park, NY (US); Gabriel Kwadwo Ofori-Okai, Albany, NY (US)

(73) Assignee: General Electric Company, Nishayuna, NY (US)

( * ) Notice: Subject to any disclaimer, the term of this patent is extended or adjusted under 35 U.S.C. 154(b) by 390 days.

(21) Appl. No.: 10/063,178

(22) Filed: Mar. 28, 2002

(65) Prior Publication Data

US 2003/0183247 A1 Oct. 2, 2003

(51) Int. Cl.[7] ..... B08B 7/00

(52) U.S. Cl. ..... 134/3; 134/2; 134/41; 216/104; 216/109; 252/79.3; 510/269

(58) Field of Search ..... 216/100, 101, 216/102, 103, 104, 108, 109; 134/2, 3, 41; 252/79.2, 79.3; 510/255, 269

(56) References Cited

U.S. PATENT DOCUMENTS 3,383,324 A * 5/1968 Yukinori ..... 423/484
4,008,130 A * 2/1977 Leathers et al. ..... 203/6
4,229,492 A * 10/1980 Leister et al. ..... 427/345
4,389,293 A * 6/1983 Mani et al. ..... 204/517
6,352,636 B1 * 3/2002 Wei et al. ..... 205/717
6,599,416 B2 * 7/2003 Kool et al. ..... 205/717
6,720,032 B1 * 4/2004 Kuhm et al. ..... 427/327
2002/0096229 A1 * 7/2002 Meagher et al. ..... 148/243
2002/0100493 A1 * 8/2002 Kool et al. ..... 134/3
2003/0083213 A1 * 5/2003 Kool et al. ..... 510/175
2003/0150527 A1 * 8/2003 Busch et al. ..... 148/254

OTHER PUBLICATIONS

ANSI/AWWA B703–89, "AWWA Standard for Hydrofluosilic Acid," American Water Works Association, Jul. 1, 1989.

* cited by examiner

*Primary Examiner*—Alexander Markoff
(74) *Attorney, Agent, or Firm*—Paul J. DiConza; Patrick K. Patnode

(57) ABSTRACT

A method for preparing a solution for treating an article, a treatment solution made thereby, and a method for treating an article with the solution are presented with, for example, the treatment method comprising providing a quantity of treatment solution, the treatment solution comprising an acid having the formula HxAF6, wherein A is selected from the group consisting of Si, Ge, Ti, Zr, Al, and Ga, and x is in the range from about 1 to about 6; determining a concentration of free acid contaminant in the treatment solution; and removing the concentration of free acid contaminant.

36 Claims, 2 Drawing Sheets

METHOD FOR PROCESSING ACID TREATMENT SOLUTION, SOLUTION PROCESSED THEREBY, AND METHOD FOR TREATING ARTICLES THEREWITH

BACKGROUND OF INVENTION

This invention relates to methods for chemically or electrochemically removing material from metal substrates. More particularly, this invention relates to methods for preparing solutions for selectively removing material from metal substrates.

A variety of coatings are used to provide oxidation resistance and thermal barrier properties to metal articles, such as turbine engine components. Current coatings used on components in gas turbine hot sections, such as blades, nozzles, combustors, and transition pieces, generally belong to one of two classes: diffusion coatings or overlay coatings. State-of-the-art diffusion coatings are generally formed of aluminide-type alloys, such as nickel-aluminide, platinum-aluminide, or nickel-platinum-aluminide. Overlay coatings typically have the composition MCrAl(X), where M is an element from the group consisting of Ni, Co, Fe, and combinations thereof, and X is an element from the group consisting of Y, Ta, Si, Hf, Ti, Zr, B, C, and combinations thereof. Diffusion coatings are formed by depositing constituent components of the coating, and reacting those components with elements from the underlying substrate, to form the coating by high temperature diffusion. In contrast, overlay coatings are generally deposited intact, without reaction with the underlying substrate.

When articles such as gas turbines are serviced, accumulations of foreign matter such as dirt and mineral deposits often need to be removed from the surface of components. In addition, protective coatings usually must be removed to permit inspection and possible repair of the underlying substrate, followed by re-coating. Removal of the coatings and foreign matter is typically carried out by immersing the component in at least one treatment solution. A variety of treatment techniques are currently available for removing different types of coatings and foreign matter from metal substrates. The techniques usually must exhibit a considerable amount of selectivity. In other words, they must remove only the intended materials, while generally preserving the article's desired structures.

One example of a particular treatment technique to remove metallic coatings and foreign matter is chemical etching. In such a process, the article is submerged in an aqueous chemical etchant. Foreign matter and the metallic coating on the article surface are then dissolved as a result of reaction with the etchant.

While many stripping techniques are very useful for a variety of applications, they may not always include the features needed in specialized situations. As an example, many forms of chemical etching are generally nonselective, and can result in undesirable loss of the substrate material. This material loss often leads to changes in critical dimensions, e.g., turbine airfoil wall thickness or cooling hole diameter. The material loss can also lead to structural degradation of the substrate alloy, e.g., by way of intergranular attack. Moreover, chemical etching can result in the stripping of coatings from internal passages in the article, which is often undesirable.

Masking techniques can be used to protect portions of a component's structure from the effects of treatment solutions. For example, masking is often used to protect the internal cooling passages and holes in turbine engine components. However, masking and the subsequent removal of the masks can be time-consuming and labor-intensive, detracting from the efficiency of a repair process.

In the case of removing metallic coatings, electrochemical stripping processes overcome some of the disadvantages inherent in conventional techniques such as chemical etching. For example, a U.S. patent application of Bin Wei et al, Ser. No. 09/420,059, describes a useful electrochemical stripping process. In general, the process selectively removes metallic coatings from the external sections of a metallic article, such as a turbine component. The process employs an electrolytic solution based on various compounds, such as organic and inorganic salt/solvent systems. Examples of electrolytic systems are ammonium chloride/ethylene glycol, and aqueous sodium chloride. An advantage of this type of process in theory is that coatings on internal passageways of the component remain unaffected by the action of the stripping agent—even when they have not been masked. However, improvements are often desirable in practical applications. For example, ammonium chloride-type electrolytes can sometimes damage the base metal of an article. Moreover, some of the electrochemical stripping processes do not provide a wide enough "process window" for efficient commercial operation, and some exhibit low selectivity due to chemical attack of coatings on internal channels. In some cases, the time period between complete stripping of the coating and the occurrence of significant damage to the substrate may be too short.

These shortcomings are addressed in the U.S. patent application of Bin Wei et al., Ser. No. 09/682,620. In part, an electrochemical method described therein includes the step of immersing the substrate in an aqueous composition comprising an acid having the formula $H_xAF_6$, where "A" is at least one of Si, Ge, Ti, Zr, Al, and Ga; and x is in the range from about 1 to about 6. This treatment solution composition provides significantly enhanced selectivity relative to other solutions, along with a sufficiently robust processing window for commercial stripping and cleaning processes. In some cases, however, difficulties arise in consistently maintaining the selectivity of the treatment solution comprising $H_xAF_6$. Therefore, there remains a need to provide improved treatment solutions and methods for selectively cleaning and stripping materials from metal articles.

SUMMARY OF INVENTION

The present invention provides several embodiments that address this need. One embodiment is a method for preparing a solution for treating an article, herein referred to as "the solution preparation method". The solution preparation method comprises providing a quantity of treatment solution, the treatment solution comprising an acid having the formula $H_xAF_6$, wherein A is selected from the group consisting of Si, Ge, Ti, Zr, Al, and Ga, and x is in the range from about 1 to about 6; determining a concentration of free acid contaminant in the treatment solution; and removing the concentration of free acid contaminant.

A second embodiment is a method for treating an article to selectively remove unwanted material. The method comprises providing an article, the article comprising unwanted material; preparing a treatment solution according to the aforementioned solution preparation method; and exposing the article to the treatment solution.

A third embodiment is treatment solution made by the aforementioned solution preparation method.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
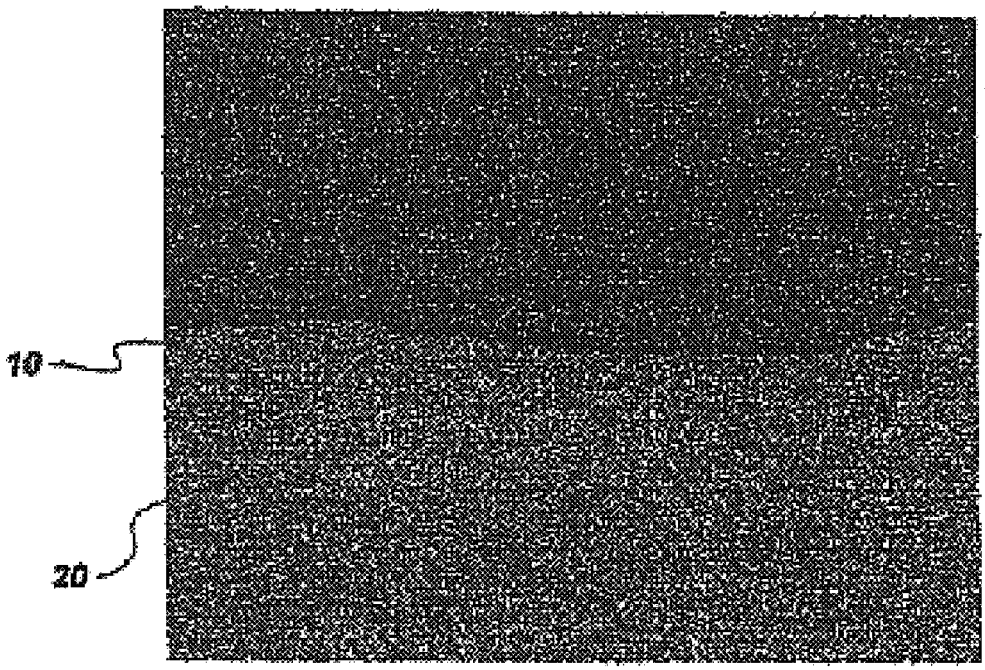
FIGS. 1–4 are photomicrographs depicting cross-sectioned corrosion test specimens.

Some solutions comprising acid having the formula $H_xAF_6$ (herein referred to as "HAF6 acid"), where "A" is at least one of Si, Ge, Ti, Zr, Al, and Ga, and x is in the range from about 1 to about 6, are available commercially, thereby providing another advantage for treatment processes that use this solution to selectively remove foreign material (as in a cleaning treatment) or a metallic coating (as in a stripping treatment) from a metal article. However, the present inventors discovered a problem with consistently maintaining a desirable degree of selectivity when treating articles with solutions comprising HAF6 acid. The problem manifested itself in a reduced level of selectivity during the process of removing foreign material or metallic coatings; in certain situations the solution undesirably attacked coatings on internal passageways of the article being stripped much more aggressively than is desirable for a commercial stripping or cleaning process, leading to unacceptable amounts of internal coating loss for the treated article. Significantly, in many cases in which this problem of reduced selectivity was observed, a commercial grade of HAF6 acid was used in making the treatment solution.

Upon further investigation, the present inventors discovered a major source of this problem of reduced selectivity. Many commercial grades of HAF6-type acid such as, for example, fluorosilicic acid, $H_2SiF_6$, (also referred to in the art as "hydrofluosilicic acid", "hexafluorosilicic acid", and "HFS"), contain from about 1% to about 5% by volume of a strongly acidic contaminant, generally reported by manufacturers in specification documentation as free hydrofluoric acid (HF). In some cases, this "free HF" may comprise other strong acids in addition to HF, including, for example, phosphoric, hydrochloric, nitric, and sulfuric acids. The present inventors discovered that this free acid contaminant was a major source of the observed decrease in the selectivity of the HAF6 acid-containing treatment solutions. The presence of this chemically aggressive contaminant caused the solution to indiscriminately attack both the material desired for removal and the material desired to remain, such as, for example, coatings on internal channels. The present inventors found that the selectivity of treatment solutions comprising HAF6 acid was dramatically improved upon neutralization of the free acid contaminant.

Consequently, the present invention provides embodiments that exploit the advantages obtained when a free acid contaminant is identified and removed from treatment solutions comprising HAF6 acid. One embodiment provides a method for preparing a solution for treating an article. This method is sometimes referred to herein as "the solution preparation method." The method comprises providing a quantity of treatment solution, the treatment solution comprising an acid having the formula $H_xAF_6$, wherein A is selected from the group consisting of Si, Ge, Ti, Zr, Al, and Ga; and x is in the range from about 1 to about 6; determining a concentration of free acid contaminant in the treatment solution; and removing the concentration of free acid contaminant. In certain embodiments, the treatment solution comprises a cleaning solution, that is, the solution is suitable for removing foreign material such as, for example, dirt, mineral deposits, and grit blasting media. In other embodiments, the treatment solution is a stripping solution, that is, the solution is suitable for removing metallic coatings by various chemical or electrochemical processes. In particular embodiments, the acid has the formula $H_2SiF_6$.

Determining the concentration of free acid contaminant is accomplished through any of several methods. Additionally, any of various analytical chemistry techniques are suitable to determine the free acid contaminant concentration, including, as non-limiting examples, fluoride electrode measurements, nuclear magnetic resonance (NMR), pH measurements, atomic absorption spectroscopy, and ion chromatography. In certain embodiments, determining the concentration comprises performing a titration on the treatment solution, and in particular embodiments, the titration comprises a two-step titration.

The following procedure is presented as a non-limiting example of a two-step titration suitable for use in embodiments of the present invention. In this example, the HAF6 acid used to make the treatment solution is HFS. The procedure set forth below is based upon a modification of the method defined and published by the American Water Works Association in the document ANSI/AWWA B703-89 entitled, "AWWA STANDARD FOR HYDROFLUOSILICIC ACID" (effective date: Jul. 1, 1989). The two titrations are performed at different temperatures, the first at 0° C. to measure "free acid" concentration, i.e., acids present other than HFS, and the second at 100° C. to measure HFS concentration.

EXAMPLE TITRATION PROCUDURE a. Pour approximately 400 mL of deionized water into a 500-mL volumetric flask. (Full-strength treatment solution should not be poured into the empty flask because it will dissolve the glass and produce an inaccurate measurement.) Using a pipette bulb, pipette 25 mL of a treatment solution sample into the flask. Immediately rinse the pipette to minimize any dissolution of the glass. Fill to the mark with deionized water and mix thoroughly.

b. Place about 100–150 mL of clean deionized ice into a 400-mL beaker, add 25 mL of saturated potassium nitrate solution (measured using a graduated cylinder). Add 5 mL of 0.2% bromothymol blue indicator solution. Using a pipette bulb, pipette a 25-mL aliquot of the diluted sample solution from the 500 mL flask into the beaker containing the ice and potassium nitrate. This will cause the HFS to precipitate as $K_2SiF_6$, which is insoluble at 0° C. Wash down the sides of the beaker with deionized water.

c. Fill a burette with 0.5N standard sodium hydroxide solution and record the starting volume. Aim a light directly at the beaker containing the sample so that it is well illuminated. While stirring constantly, promptly titrate with the standard sodium hydroxide solution, using bromothymol blue as the end-point indicator. The end point has been reached when the blue color persists for at least 30 s. On standing longer, the indicator will turn yellow. Repeat steps 1 3 until three successive titrations produce results that are within 5% of each other.

d. The titration at 0° C. quantifies any free acid other than hydrofluosilicic acid that may be present. Next, heat to a boil the solution that has just been titrated at 0° C., while continuing to stir. Titrate the hot solution with the standard sodium hydroxide to the neutral point of the bromothymol blue. This titration breaks down the fluosilicate anion of the potassium fluosilicate:

$$K_2SiF_6+4NaOH \rightarrow 2KF+4NaF+SiO_2+2H_2O$$

The calculations of acid concentrations are based upon the following chemical equations:

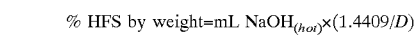

$$H_2SiF_6+2KNO_3 \rightarrow K_2SiF_6+2HNO_3$$

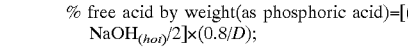

$$HNO_3+NaOH \rightarrow NaNO_3+H_2O$$

The concentrations of free acid and HFS are calculated using the following formulae:

$$\%\ \text{HFS by weight} = \text{mL NaOH}_{(hot)} \times (1.4409/D) \quad \text{a.}$$

$$\%\ \text{free acid by weight(as phosphoric acid)} = [(\text{mL NaOH}_{(cold)} - \text{mL NaOH}_{(hot)}/2] \times (0.8/D); \quad \text{b.}$$

where D is the density of the treatment solution in g/ml. The density of the treatment solution will in part depend on the concentration of the HFS or other HAF6-type acid present in the treatment solution. Generally, the commercial grades of HAF6 acids comprise up to about 30% HAF6 acid by weight. Such grades are suitable for use in embodiments of the present invention. In particular embodiments, the concentration of HAF6 acid in the treatment solution is in the range from about 5% to about 23% by weight, and in specific embodiments the concentration is in the range from about 10% to about 23% by weight.

Removing the concentration of free acid contaminant enhances the selectivity (the property of removing only the intended materials, while generally preserving the article's desired structures) of the treatment solution and is accomplished using any of a variety of methods. In some embodiments, removing comprises employing at least one technique selected from the group consisting of separation by selective membrane, separation by trapping in zeolites, and organic extraction. In other embodiments, removing comprises adding a neutralizing agent to the treatment solution. Those skilled in the art will appreciate that the amount of neutralizing agent added to the treatment solution is related to the concentration of free acid contaminant determined for the solution by simple calculations of molar equivalents. In certain embodiments, adding a neutralizing agent comprises adding an effective amount of the neutralizing agent to consume substantially all of the concentration of free acid contaminant. For example, where a particular neutralizing agent reacts with a particular free acid contaminant according to the following example reaction:

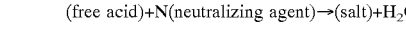

$$\text{(free acid)} + N\text{(neutralizing agent)} \rightarrow \text{(salt)} + H_2O,$$

The free acid contaminant concentration determined as described above is converted into a number of moles, and this number is then multiplied by N to determine the minimum number of moles of neutralizing agent needed to consume substantially all of the concentration of free acid contaminant. Such embodiments include instances in which an excess of neutralizing agent is added to the solution, above that required to consume substantially all of the concentration of free acid contaminant, based on calculations of molar equivalents. As used herein, "substantially all" means at least 95% of the concentration of free acid contaminant.

In certain embodiments, the neutralizing agent comprises a base. "Base" as used herein refers to any compound that, when exposed to the free acid contaminant, reacts with the free acid contaminant to produce at least a salt and water. In particular embodiments, the base comprises at least one compound selected from the group consisting of ammonia, amines, ammonium hydroxide, sodium hydroxide, potassium hydroxide, sodium carbonate, potassium carbonate, sodium bicarbonate, and potassium bicarbonate.

In other embodiments, the neutralizing agent comprises a metal. The metal is introduced into the solution in any of a number of suitable forms, such as, for example, powder, strip, sheet, or flake. The metal used as neutralizing agent is any metal that, upon exposure to the free acid contaminant, reacts with the acid to form at least hydrogen gas and a metal salt. In particular embodiments, the metal comprises at least one of aluminum, magnesium, iron, nickel, copper, zinc, and calcium.

In other embodiments, removing the concentration of free acid contaminant comprises electrochemically reducing the free acid contaminant. In such embodiments, an electrochemical apparatus commonly used in the art is employed, wherein a consumable anode and an inert cathode, in electrical contact with each other and coupled to a DC potential source, are introduced into the solution. Hydrogen ions from the free acid contaminant are exposed to an electrochemical potential sufficient to reduce the ions to form hydrogen gas at the cathode, which is made of an inert material, such as, for example, gold or platinum. The corresponding anodic reaction takes place in the dissolution of the anode, comprising aluminum, for example, into the solution.

Those skilled in the art will appreciate that the particular techniques selected for use in determining the concentration of free acid contaminant and in removing the concentration of free acid contaminant from the treatment solution will depend on several factors, among them, for example, the identity of the particular HAF6-type acid in the treatment solution and processing costs. For example, in particular embodiments, the method for preparing a solution for treating an article comprises providing a quantity of treatment solution, the treatment solution comprising commercial grade fluorosilicic acid ($H_2SiF_6$) solution; performing a two-step titration to determine a concentration of free acid contaminant; and adding to the treatment solution an effective amount of a base to consume substantially all of the concentration of free acid contaminant. This embodiment takes advantage of several cost-related considerations, including, for example, the high availability of commercial-grade $H_2SiF_6$ and suitable base compounds, along with the relative speed and simplicity of performing a two-step titration to determine the concentration of free acid contaminant.

Embodiments of the present invention also include a treatment solution made by the aforementioned solution preparation method, as set forth above. Such solutions are particularly useful for selectively stripping a metallic coating from a gas turbine engine component, because determining and removing the concentration of free acid contaminant enhances the selectivity of the solution, thereby allowing the removal of metallic coatings from the turbine component while preserving the structure of the base metal and coatings on internal channels, such as internal air-cooling passages.

Another embodiment of the present invention is a method for treating an article to selectively remove unwanted material. The method comprises providing an article, the article comprising unwanted material, performing the solution preparation method as described above, and exposing the article to the treatment solution. In certain embodiments, providing the article comprises providing a metallic article, and in particular embodiments, the metallic article comprises a gas turbine engine component.

In some embodiments, the unwanted material of the provided article comprises at least one of dirt, grit blasting media, and mineral deposits. Generally, such embodiments are referred to in the art as "cleaning processes." In other embodiments, the unwanted material of the provided article comprises a metallic coating for example a metallic coating comprising an aluminide and such embodiments are referred to in the art as "stripping processes." Cleaning and stripping processes may involve electrochemical removal of the metallic coatings, such as, for example, the aforementioned method according to Bin Wei et al., Ser. No. 09/682,620, or simply immersing the coated article in the solution to allow a chemical reaction to remove the unwanted material. The various alternatives for steps comprising the solution preparation method, set forth above, are applicable to the embodiments pertaining to removal of unwanted material.

The following examples are presented to demonstrate results obtained with the methods and solutions of the present invention and are not to be considered as limiting the scope of the present invention in any way.

A superalloy turbine blade comprising internal cooling passages coated with a standard nickel aluminide diffusion coating was cross-sectioned to expose the coated channels and then cut into several specimens to test the effect of exposure to various stripping processes. FIG. 1 shows an exemplary specimen prior to exposure, with the pristine coating 10 disposed on the superalloy substrate 20.

Figure 2:
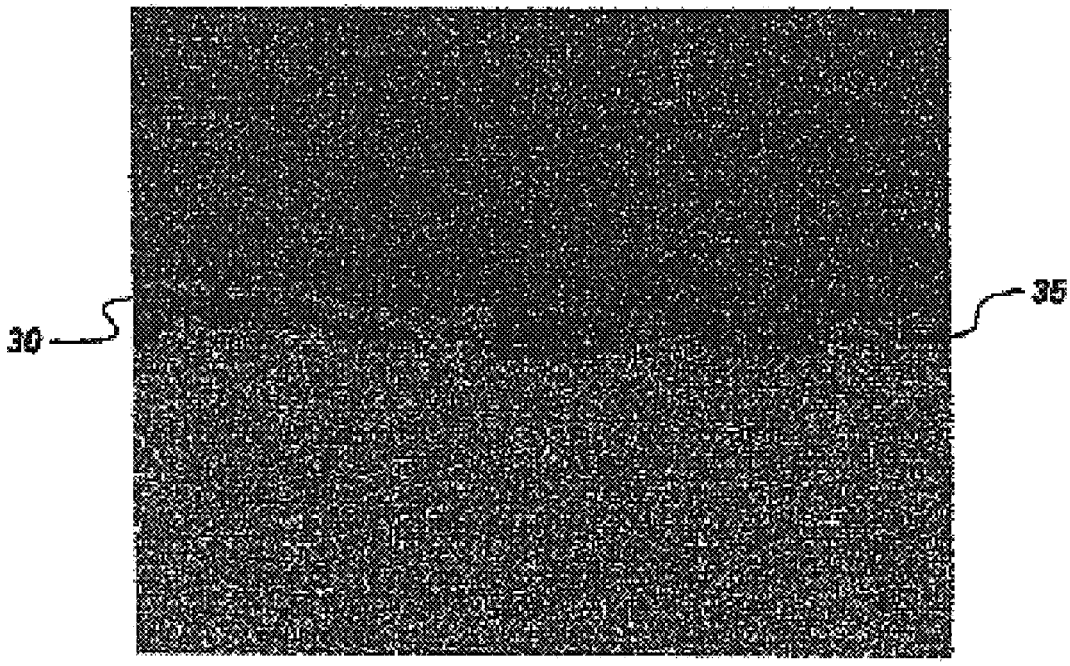

The specimen shown in FIG. 2 was exposed for 6 hours at room temperature in commercial grade HFS. Areas of severe chemical attack 30 are clearly visible on the coating 35 of this specimen.

Figure 3:
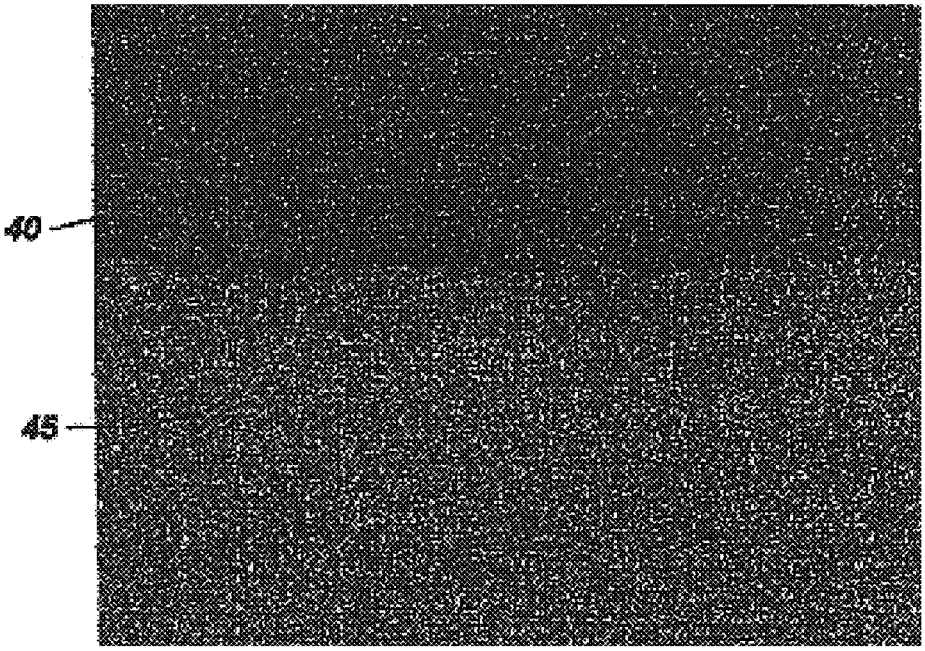

The concentration of free acid contaminant in the HFS used in the example above was then determined using the two-step titration procedure described above. The specimen shown in FIG. 3 was exposed for 6 hours at room temperature in the commercial grade HFS to which was added the amount of ammonium hydroxide calculated to be necessary to neutralize substantially all of the measured concentration of free acid contaminant. A much smaller amount of chemical attack 40 was observed in the coating 45 of this specimen in comparison to the specimen of FIG. 2.

Figure 4:
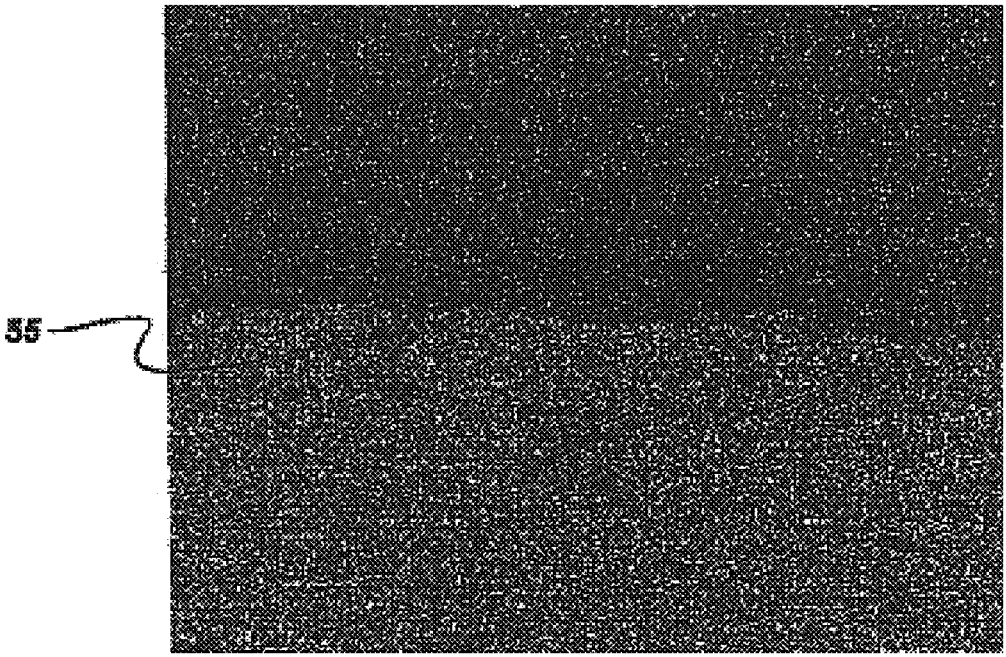

The specimen shown in FIG. 4 was exposed for 6 hours at room temperature in the commercial grade HFS to which was added twice the amount of ammonium hydroxide calculated to be necessary to neutralize substantially all of the measured concentration of free acid contaminant. Little, if any, chemical attack was observed on the coating 55 of this specimen.

While various embodiments are described herein, it will be appreciated from the specification that various combinations of elements, variations, equivalents, or improvements therein may be made by those skilled in the art, and are still within the scope of the invention as defined in the appended claims.

What is claimed is:

1. A method for preparing a solution for treating an article, said method comprising:

providing a quantity of treatment solution, said treatment solution comprising an acid having the formula HxAF6, wherein A is selected from the group consisting of Si, Ge, Ti, Zr, Al, and Ga; and x is in the range from about 1 to about 6;

determining a concentration of free acid contaminant in said treatment solution; and removing said concentration of free acid contaminant.

2. The method of claim 1, wherein determining said concentration comprises performing a titration on said treatment solution.

3. The method of claim 2, wherein said titration comprises a two-step titration.

4. The method of claim 1, wherein removing comprises employing at least one technique selected from the group consisting of separation by selective membrane, separation by trapping in zeolites, and organic extraction.

5. The method of claim 1, wherein removing comprises adding a neutralizing agent to said treatment solution.

6. The method of claim 5, wherein adding a neutralizing agent comprises adding an effective amount of said neutralizing agent to consume substantially all of said concentration of free acid contaminant.

7. The method of claim 5, wherein said neutralizing agent comprises a base.

8. The method of claim 7, wherein said base comprises at least one compound selected from the group consisting of ammonia, amines, ammonium hydroxide, sodium hydroxide, potassium hydroxide, sodium carbonate, potassium carbonate, sodium bicarbonate, and potassium bicarbonate.

9. The method of claim 5, wherein said neutralizing agent comprises a metal.

10. The method of claim 9, wherein said metal comprises at least one of aluminum, magnesium, iron, nickel, copper, zinc, and calcium.

11. The method of claim 1, wherein removing comprises electrochemically reducing said free acid contaminant.

12. The method of claim 1, wherein said treatment solution comprises a cleaning solution.

13. The method of claim 1, wherein said treatment solution comprises a stripping solution.

14. The method of claim 1, wherein said acid has the formula $H_2SiF_6$.

15. A method for preparing a solution for treating an article, said method comprising:

providing a quantity of treatment solution, said treatment solution comprising commercial grade fluorosilicic acid ($H_2SiF_6$) solution;

performing a two-step titration to determine a concentration of free acid contaminant; and adding to said treatment solution an effective amount of a base to consume substantially all of said concentration of free acid contaminant.

16. A method for treating an article to selectively remove unwanted material, said method comprising:

providing an article, said article comprising unwanted material;

providing a quantity of treatment solution, said treatment solution comprising an acid having the formula HxAF6, wherein A is selected from the group consisting of Si, Ge, Ti, Zr, Al, and Ga; and x is in the range from about 1 to about 6;

determining a concentration of free acid contaminant in said treatment solution;

removing said concentration of free acid contaminant; and exposing said article to said treatment solution.

17. The method of claim 16, wherein providing an article comprises providing a metallic article.

18. The method of claim 17, wherein said metallic article comprises a gas turbine engine component.

19. The method of claim 16, wherein said unwanted material comprises at least one of dirt, grit blasting media, and mineral deposits.

20. The method of claim 16, wherein said unwanted material comprises a metallic coating.

21. The method of claim 20, wherein said metallic coating comprises an aluminide.

22. The method of claim 16, wherein determining said concentration comprises performing a titration on said treatment solution.

23. The method of claim 22, wherein said titration comprises a two-step titration.

24. The method of claim 16, wherein removing comprises adding a neutralizing agent to said treatment solution.

25. The method of claim 24, wherein adding a neutralizing agent comprises adding an effective amount of said neutralizing agent to consume substantially all of said concentration of free acid contaminant.

26. The method of claim 24, wherein said neutralizing agent comprises a base.

27. The method of claim 26, wherein said base comprises at least one compound selected from the group consisting of ammonia, amines, ammonium hydroxide, sodium hydroxide, potassium hydroxide, sodium carbonate, potassium carbonate, sodium bicarbonate, and potassium bicarbonate.

28. The method of claim 16, wherein said acid has the formula $H_2SiF_6$.

29. A method for selectively stripping a metallic coating from a gas turbine engine component, said method comprising:

providing a gas turbine engine component comprising a metallic coating;

providing a quantity of treatment solution, said treatment solution comprising commercial grade fluorosilicic acid ($H_2SiF_6$) solution;

performing a two-step titration to determine a concentration of free acid contaminant;

adding to said treatment solution an effective amount of a base to consume substantially all of said concentration of free acid contaminant; and exposing said gas turbine engine component to said treatment solution.

30. A treatment solution made by a process, the process comprising providing a quantity of treatment solution, said treatment solution comprising an acid having the formula HxAF6, wherein A is selected from the group consisting of Si, Ge, Ti, Zr, Al, and Ga; and x is in the range from about 1 to about 6;

determining a concentration of free acid contaminant in said treatment solution; and removing said concentration of free acid contaminant.

31. The treatment solution of claim 30, wherein removing comprises adding a neutralizing agent to said treatment solution.

32. The treatment solution of claim 31, wherein adding a neutralizing agent comprises adding an effective amount of said neutralizing agent to consume substantially all of said concentration of free acid contaminant.

33. The treatment solution of claim 31, wherein said neutralizing agent comprises a base.

34. The treatment solution of claim 33, wherein said base comprises at least one compound selected from the group consisting of ammonia, amines, ammonium hydroxide, sodium hydroxide, potassium hydroxide, sodium carbonate, potassium carbonate, sodium bicarbonate, and potassium bicarbonate.

35. The treatment solution of claim 30, wherein said acid has the formula $H_2SiF_6$.

36. A solution for selectively stripping a metallic coating from a gas turbine engine component, said solution made by a process, said process comprising providing a quantity of treatment solution, said treatment solution comprising commercial grade fluorosilicic acid ($H_2$ $SiF_6$) solution;

performing a two-step titration to determine a concentration of free acid contaminant;

adding to said treatment solution an effective amount of a base to consume substantially all of said concentration of free acid contaminant.

* * * * *